US011668034B2

(12) United States Patent
Sato et al.

(10) Patent No.: US 11,668,034 B2
(45) Date of Patent: Jun. 6, 2023

(54) SEWING MACHINE

(71) Applicant: JANOME SEWING MACHINE CO., LTD., Tokyo (JP)

(72) Inventors: Syuichi Sato, Tokyo (JP); Jun Mafune, Tokyo (JP)

(73) Assignee: JANOME SEWING MACHINE CO., LTD., Tokyo (JP)

( * ) Notice: Subject to any disclaimer, the term of this patent is extended or adjusted under 35 U.S.C. 154(b) by 0 days.

(21) Appl. No.: 17/494,108

(22) Filed: Oct. 5, 2021

(65) Prior Publication Data

US 2022/0127769 A1 Apr. 28, 2022

(30) Foreign Application Priority Data

Oct. 28, 2020 (JP) ..... JP2020-180118

(51) Int. Cl.
*D05B 3/02* (2006.01)
*D05B 57/36* (2006.01)

(52) U.S. Cl.
CPC ..... *D05B 3/02* (2013.01); *D05B 57/36* (2013.01)

(58) Field of Classification Search
CPC . D05B 3/02; D05B 3/00; D05B 57/04; D05B 57/143; D05B 57/14; D05B 57/08; D05B 57/10; D05B 69/00; D05B 69/02; D05B 69/04; D05B 69/10; D05B 69/14; D05B 69/16; D05B 69/30
See application file for complete search history.

(56) References Cited

U.S. PATENT DOCUMENTS 3,817,114 A * 6/1974 Klee ..... F16H 7/1281 474/134
6,095,070 A * 8/2000 Sahl ..... D05B 27/14 112/304
7,597,058 B2 * 10/2009 Ishikawa ..... D05B 3/02 112/190
9,670,608 B2 * 6/2017 Nakajima ..... D05B 69/02

FOREIGN PATENT DOCUMENTS

DE 102007031072 A1 * 2/2008 ..... D05B 55/14
EP 2952618 A1 * 12/2015 ..... D05B 3/02
JP 2016154776 A 9/2016
JP 2019154510 A 9/2019

OTHER PUBLICATIONS

First Office Action dated Dec. 15, 2022 corresponding to TW Application No. 110136348.

* cited by examiner

*Primary Examiner* — Ismael Izaguirre
(74) *Attorney, Agent, or Firm* — Nath, Goldberg & Meyer; Jerald L. Meyer

(57) ABSTRACT

A sewing machine according to the present invention includes: an upper shaft that drives a needle and a balance; a lower shaft that drives a hook and a feed dog; an upper and lower shaft belt that synchronizes rotation of the upper shaft with rotation of the lower shaft; and an idler unit that pushes an idler into the upper and lower shaft belt to change a tension side belt length, in which the idler unit includes a transmission mechanism connected to the upper shaft or the lower shaft, and a rotating body mechanism provided with the idler and having a rotating body that rotates in synchronization with the upper shaft or the lower shaft by the transmission mechanism, and a pushing amount of the idler into the upper and lower shaft belt is changed according to rotation of the rotating body.

10 Claims, 11 Drawing Sheets

C
T
20
10
δ1
δ2
δ3
δ4

SEWING MACHINE

BACKGROUND

Technical Field

The present invention relates to a sewing machine capable of adjusting operation timings of an upper shaft that drives a needle and a balance and a lower shaft that drives a hook and a feed dog.

Related Art

A sewing machine forms a stitch by entangling an upper thread and a lower thread by vertical motion of a needle through which the upper thread is inserted and rotational motion of a hook accommodating the lower thread. Thereafter, the upper thread is tightened by a balance to complete the stitch, and fabric is fed to a next stitch formation point by a feed dog, so that sewing is performed. The needle, the balance, the hook, and the feed dog are connected to a sewing machine motor as a prime mover via an upper shaft or a lower shaft, and when the sewing machine motor is driven, the needle, the balance, the hook, and the feed dog operate in conjunction with each other. In addition, operation timings of these elements are adjusted when the sewing machine is assembled.

On the other hand, since optimal operation timings of elements constituting the sewing machine vary depending on the way of sewing and the type of fabric to be sewn, it is difficult to uniquely determine the optimal operation timings. For example, in so-called zigzag sewing in which sewing is performed while the needle moves left and right with respect to a fabric feeding direction, a relative position between the needle and the hook changes, and accordingly, a timing at which the needle and the hook come close to each other changes. In addition, it is known that when thin fabric is sewn, a timing of feeding fabric with respect to movement of the balance is advanced as compared with thick fabric, so that the fabric can be sewn with soft stitches by applying resistance to narrowing of the thread. For this purpose, it is necessary to adjust the operation timing of the balance and the feed dog according to the fabric thickness.

Here, JP 2019-154510 A proposes a configuration in which an idler is moved with respect to a toothed belt that rotates an upper shaft that drives a needle and a lower shaft that drives a hook in conjunction with each other, a pushing amount of the idler with respect to the toothed belt is changed at a timing when the needle and the hook come closest to each other to change a tension side belt length of the toothed belt, whereby the lower shaft is relatively rotated with respect to the upper shaft to generate a difference in rotation angle (phase difference) between the upper shaft and the lower shaft, thereby correcting a difference in timing between the needle and the hook when the needle is moved left and right.

In addition, JP 2016-154776 A proposes that an idler is moved with respect to a toothed belt that rotates an upper shaft that drives a balance and a lower shaft that drives a feed dog in conjunction with each other, thereby changing a tension side belt length of the toothed belt at a time of feeding fabric, thereby changing a timing of feeding fabric by the feed dog with respect to vertical motion of the balance.

SUMMARY

When an upper shaft is driven, a needle and a balance operate in conjunction with each other, and when a lower shaft is driven, a hook and a feed dog operate in conjunction with each other. Therefore, for example, when a phase difference is generated between the upper shaft and the lower shaft in order to correct a difference in timing when the needle and the hook come closest to each other, an operation timing of the balance and the feed dog is also affected.

As a method of avoiding the influence on the operation timing of the balance and the feed dog, it is conceivable to change a phase of the upper shaft or the lower shaft at a timing when the needle and the hook come closest to each other, and then return, to an original phase, the phase that has been changed before fabric is fed by the feed dog. Here, in the sewing machines of JP 2019-154510 A and JP 2016-154776 A, the phase of the upper shaft or the lower shaft is changed by moving the idler with a stepping motor. In order to change the phase and return the changed phase to the original phase without reducing a sewing speed, the stepping motor needs to be driven at high speed. However, since it is technically difficult to drive the stepping motor at high speed, the sewing speed needs to be reduced in order to realize such an operation with the sewing machines of JP 2019-154510 A and JP 2016-154776 A.

In view of such a problem, an object of the present invention is to provide a sewing machine capable of optimizing operation timings of a needle, a balance, a hook, and a feed dog without reducing a sewing speed, and capable of performing zigzag sewing and sewing of fabrics having different thicknesses at high speed and with high quality.

The present invention is a sewing machine including: an upper shaft that drives a needle and a balance; a lower shaft that drives a hook and a feed dog; an upper and lower shaft belt that connects the upper shaft and the lower shaft and synchronizes rotation of the upper shaft with rotation of the lower shaft; and an idler unit that includes an idler that comes into contact with the upper and lower shaft belt and pushes the idler into the upper and lower shaft belt to change a tension side belt length, in which the idler unit includes a transmission mechanism connected to the upper shaft or the lower shaft, and a rotating body mechanism provided with the idler and having a rotating body that rotates in synchronization with the upper shaft or the lower shaft by the transmission mechanism, and wherein a pushing amount of the idler into the upper and lower shaft belt is changed according to rotation of the rotating body.

In such a sewing machine, the pushing amount is preferably maximum when a needle hole of the needle is located below a needle plate.

In addition, in the sewing machine described above, the pushing amount is preferably maximum when the feed dog is located above the needle plate.

Further, a center of gravity of the rotating body mechanism is preferably located on a rotation axis of the rotating body.

Furthermore, the idler unit preferably includes a swing mechanism that is swingable around the upper shaft or the lower shaft and swings the rotating body with respect to the upper and lower shaft belt.

In the sewing machine of the present invention, the rotating body provided with the idler can be rotated in synchronization with the upper shaft or the lower shaft by the transmission mechanism connected to the upper shaft or the lower shaft, whereby the pushing amount of the idler into the upper and lower shaft belt connecting the upper shaft and the lower shaft can be changed. Therefore, the operation timings of the needle, the balance, the hook, and the feed dog can be optimized without reducing the sewing speed, and zigzag sewing and sewing of fabrics having different thicknesses can be performed at high speed and with high quality.

DETAILED DESCRIPTION

Figure 1:
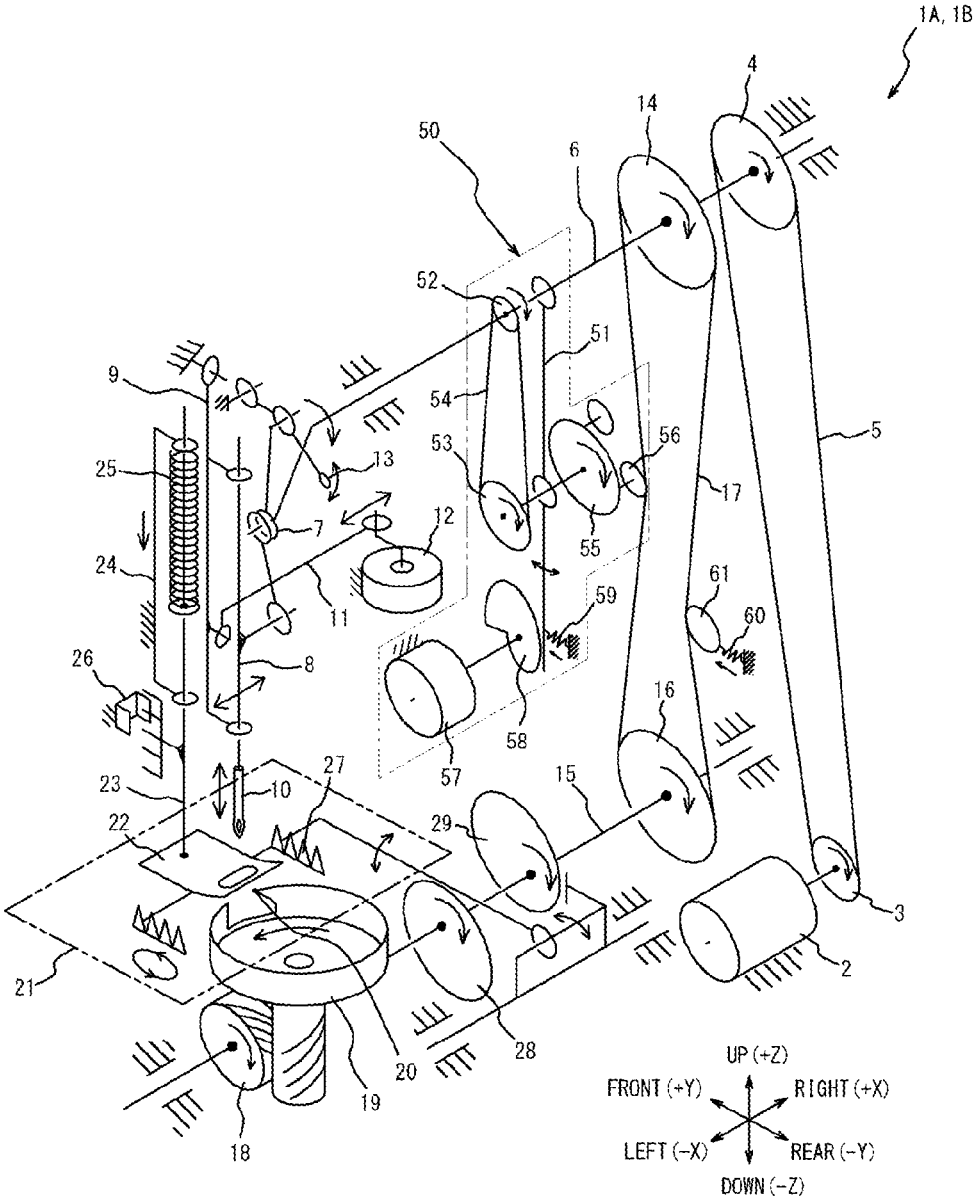
FIG. 1 is a schematic view of a first embodiment and a second embodiment of a sewing machine according to the present invention.

Hereinafter, a sewing machine 1A according to a first embodiment and a sewing machine 1B according to a second embodiment embodying a sewing machine according to the present invention will be described with reference to the drawings. As will be described later, the sewing machines 1A and 1B have a different positional relationship between an upper shaft 6 and a rotating body 55, but have a common basic configuration. In the following description, the basic configuration of the sewing machines 1A and 1B will be described with reference to FIGS. 1 to 4, the sewing machine 1A will be described with reference to FIGS. 5 to 7, and the sewing machine 1B will be described with reference to FIGS. 8 to 10. In the following description, for the sake of convenience, the description will be given in directions of right, left, front, rear, up, and down illustrated in the drawings.

The sewing machines 1A and 1B of the present embodiment are lock-stitch sewing machines that form stitches by entangling an upper thread and a lower thread. As illustrated in FIG. 1, each of the sewing machines 1A and 1B includes a sewing machine motor 2, and rotational driving force of the sewing machine motor 2 is transmitted to the upper shaft 6 by a lower motor pulley 3, an upper motor pulley 4, and a motor belt 5. The upper shaft 6 is provided with a crank mechanism 7, and rotational motion of the upper shaft 6 is converted into linear motion by the crank mechanism 7 to drive a needle bar 8 in a vertical direction. A base (a sewing machine arm, a cover immovable with respect to the sewing machine arm, or the like) of the sewing machines 1A and 1B is provided with needle bar support 9 that is swingably supported with respect to the base, and the needle bar 8 is supported movably in the vertical direction with respect to the needle bar support 9. A needle 10 is attached to a lower end of the needle bar 8. A needle hole through which the upper thread is inserted is provided at a distal end of the needle 10. In addition, the needle bar support 9 is connected to a needle bar swing motor 12 via a needle bar swing link 11. By driving the needle bar swing motor 12, the needle bar 8 can be swung in a direction (left-right direction) perpendicular to a fabric feeding direction (front-rear direction), so that sewing called zigzag sewing or pattern sewing can be performed.

The crank mechanism 7 described above is also engaged with a balance 13 that tightens the upper thread, and the balance 13 moves in the vertical direction with rotation of the upper shaft 6.

In addition, an upper shaft pulley 14 is provided on the upper shaft 6, and a lower shaft pulley 16 is provided on a lower shaft 15 that is disposed parallel to the upper shaft 6 below the upper shaft 6. An upper and lower shaft belt 17 is wound around the upper shaft pulley 14 and the lower shaft pulley 16, and when the upper shaft 6 rotates, the lower shaft 15 also rotates in conjunction therewith.

The lower shaft 15 is provided with a gear mechanism 18. Rotational motion of the lower shaft 15 is transmitted to a hook 19 via the gear mechanism 18, and the hook 19 rotates in a direction of the illustrated arrow. The hook 19 accommodates a bobbin (not illustrated) accommodating the lower thread. The hook 19 also includes a hook-shaped tip 20.

A needle plate 21 indicated by a virtual line in FIG. 1 is provided above the hook 19. A presser 22 is provided above the needle plate 21. The presser 22 is provided at a lower distal end of a presser bar 23, and the presser bar 23 is supported by a presser bar support 24 so as to be movable in the vertical direction. In addition, the presser bar 23 is biased downward by a presser spring 25. Note that fabric to be sewn is sandwiched between the needle plate 21 and the presser 22 while being placed on the needle plate 21. In addition, each of the sewing machines 1A and 1B of the present embodiment includes a fabric thickness sensor 26 capable of detecting a fabric thickness sandwiched between the needle plate 21 and the presser 22 by detecting a height of the presser bar support 24.

Figures 2A, 2B, 2C, 2D, 2E:
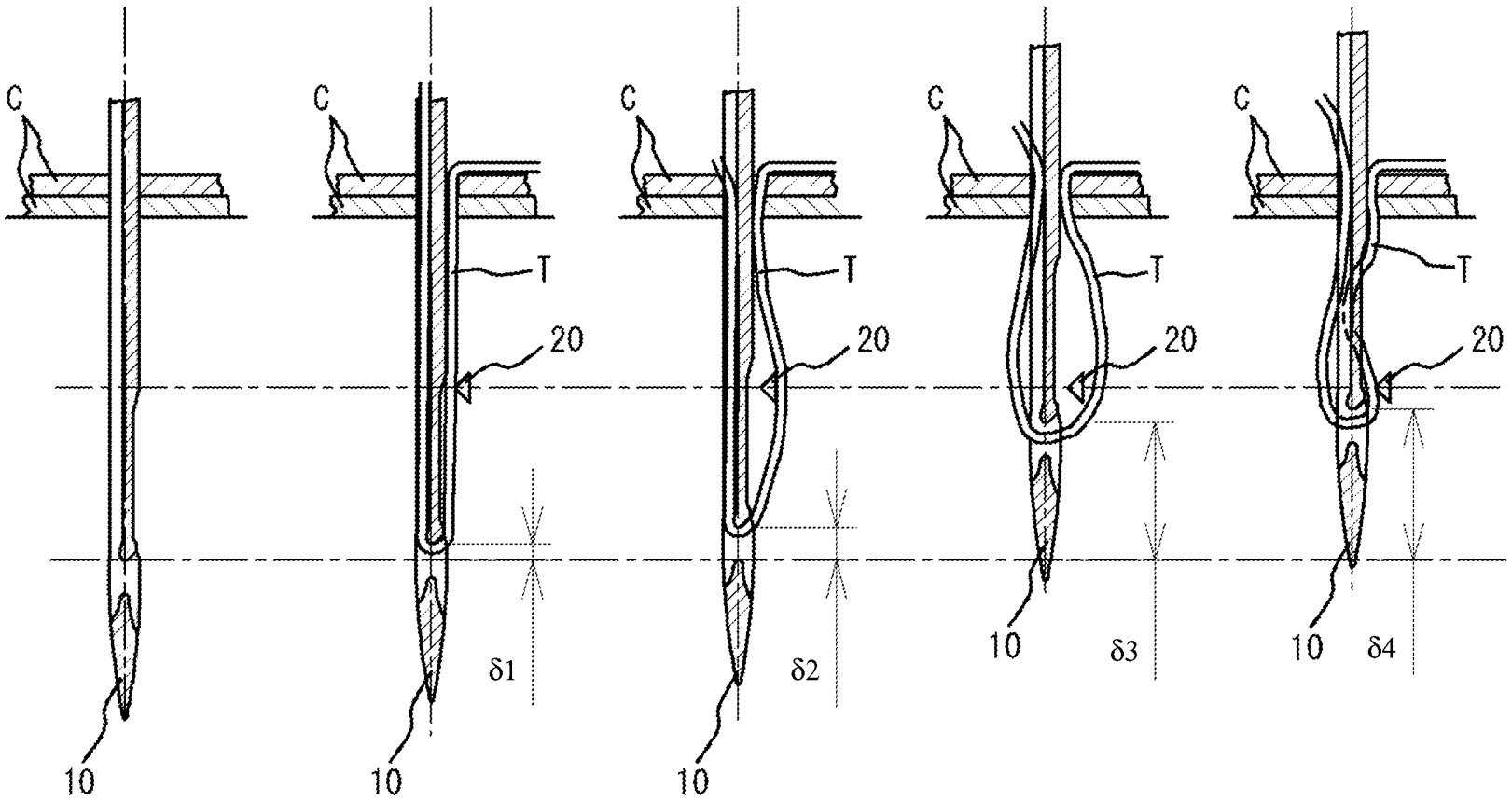
FIGS. 2A to 2E are explanatory views illustrating a relationship between a position of a needle and a loop of an upper thread.

Here, a method of entangling the upper thread inserted through the needle hole of the needle 10 and the lower thread accommodated in the hook 19 will be described in detail with reference to FIGS. 2A to 2E. FIG. 2A illustrates a state in which the needle 10 is lowered with two pieces of fabric C placed on the needle plate 21, and the needle 10 penetrates the fabric C and reaches a lowest point (bottom dead center). For convenience, the upper thread is omitted in FIG. 2A. Even when the needle 10 starts to rise from the state of FIG. 2A, an upper thread T remains in a portion penetrating the fabric due to resistance with the fabric C. Therefore, as illustrated in FIGS. 2C and 2D, when the needle 10 rises from the lowest point to δ2 to δ3, a part of the upper thread T forms a ring shape (a loop is formed). On the other hand, the hook 19 rotates in the direction of the arrow illustrated in FIG. 1. Therefore, the tip 20 is passed through the loop at a timing when the loop is formed by the upper thread to catch and pull the upper thread, and the upper thread is passed through the lower thread of the bobbin accommodated in the hook 19 to open the loop, whereby the upper thread and the lower thread are entangled to form a stitch. Note that a size of the loop that can be caught by the tip 20 is limited. Therefore, as illustrated in FIG. 2B, a loop is not formed when a rising amount of the needle 10 is small ($\delta 1<\delta 2$), and as illustrated in FIG. 2E, the loop is crushed when the rising amount of the needle 10 is large ($\delta 3<\delta 4$). Therefore, drive timings of components of the sewing machines 1A and 1B are set such that the tip 20 comes closest at a timing when the rising amount of the needle 10 becomes $\delta 2$ to $\delta 3$.

As illustrated in FIG. 1, a feed dog 27 for advancing fabric is provided below the needle plate 21. The feed dog 27 is driven by an upper and lower cam 28 and a front and rear cam 29 provided on the lower shaft 15, and operates in an elliptical trajectory. Note that the needle plate 21 includes a through hole (not illustrated) at a position corresponding to the feed dog 27, and the feed dog 27 repeats a state of protruding upward from the needle plate 21 and advancing and a state of being buried below the needle plate 21 and retreating by operating in an elliptical trajectory. Note that the feed dog 27 is buried in the needle plate 21 while the needle 10 is stuck in the fabric placed on the needle plate 21 to form a stitch, and protrudes from the needle plate 21 to advance the fabric while the needle 10 is pulled out from the fabric. That is, the fabric to be sewn is intermittently advanced by the feed dog 27.

Here, the balance 13 illustrated in FIG. 1 moves downward to supply the upper thread necessary for forming a stitch when the needle 10 forms the stitch, and moves upward to tighten the upper thread in a second half of formation of the stitch.

By operating the needle 10, the hook 19, the balance 13, and the feed dog 27 in this manner at appropriate timings, it is possible to form continuous stitches on the fabric.

Figure 3:
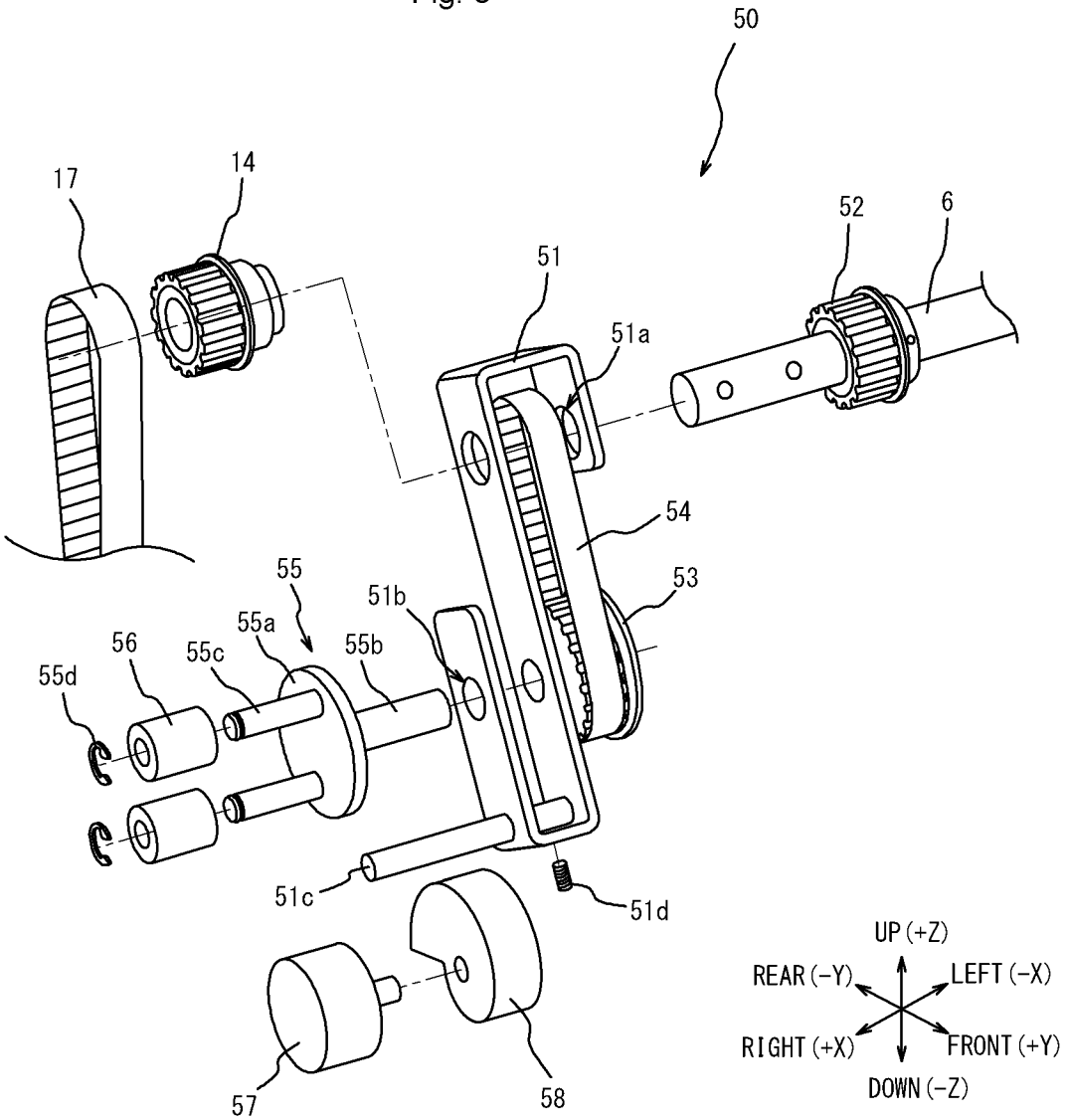
FIG. 3 is an exploded perspective view of an idler unit illustrated in FIG. 1.

Each of the sewing machines 1A and 1B of the present embodiment includes an idler unit 50 illustrated in FIGS. 1 and 3 in addition to such components. The idler unit 50 of the present embodiment includes a base plate 51, an upper synchronous drive pulley 52, a lower synchronous drive pulley 53, a synchronous drive belt 54, the rotating body 55, an idler 56, a change amount switching motor 57, a change amount switching cam 58, and a pressing spring 59 (not illustrated in FIG. 3). Note that the upper synchronous drive pulley 52, the lower synchronous drive pulley 53, and the synchronous drive belt 54 correspond to a "transmission mechanism" in the present specification, the rotating body 55 and the idler 56 correspond to a "rotating body mechanism" in the present specification, and the base plate 51, the change amount switching motor 57, the change amount switching cam 58, and the pressing spring 59 correspond to a "swing mechanism" in the present specification.

As illustrated in FIG. 3, in the present embodiment, the base plate 51 has a form in which a plate-shaped material is bent in a substantially S-shape. As illustrated in the drawing, the base plate 51 is provided with two holes 51*a*, into which the upper shaft 6 is inserted, so as to face each other, whereby the base plate 51 is swingably supported with respect to the upper shaft 6. In addition, the base plate 51 is also provided with two holes 51*b* facing each other, a shaft portion 55*b* of the rotating body 55 described later is inserted into the holes 51*b*, and the rotating body 55 is rotatably supported by the base plate 51. In addition, a cylindrical contact 51*c* is fixed to the base plate 51 by a retaining screw 51*d*.

The upper synchronous drive pulley 52 is attached to the upper shaft 6 and rotates together with the upper shaft 6. Rotational motion of the upper synchronous drive pulley 52 is transmitted to the lower synchronous drive pulley 53 by the synchronous drive belt 54. In FIG. 3, the upper synchronous drive pulley 52 is attached to the upper shaft 6 in a state where the upper shaft 6 is separated from the base plate 51 for the sake of convenience. However, the upper synchronous drive pulley 52 is attached to the upper shaft 6 in a state where the upper synchronous drive pulley 52 is located between the two holes 51*a* facing each other in the base plate 51 (in a state where the synchronous drive belt 54 is wound around the upper synchronous drive pulley 52).

In the present embodiment, as illustrated in FIG. 3, the rotating body 55 includes a disc portion 55*a*, a cylindrical shaft portion 55*b* provided on a central axis of the disc portion 55*a* on one surface side of the disc portion 55*a*, two cylindrical shaft parts 55*c* provided symmetrically with respect to the central axis of the shaft portion 55*b* on another surface side of the disc portion 55*a*, and E-rings 55*d* fixed to distal end portions of the shaft parts 55*c*. The lower synchronous drive pulley 53 is attached to the shaft portion 55*b* in a state where the shaft portion 55*b* is inserted into the holes 51*b* of the base plate 51. As a result, when the upper shaft 6 rotates, the rotating body 55 also rotates synchronously. After the idler 56 having a cylindrical shape is inserted into each of the shaft parts 55*c*, each of the E-rings 55*d* is attached to the shaft part 55*c*. As a result, the idler 56 is rotatably supported with respect to the shaft part 55*c*. The idler 56 is provided at a position facing a tension side of the upper and lower shaft belt 17 (see FIG.

The change amount switching motor 57 is attached to the base of each of the sewing machines 1A and 1B (a sewing machine arm, a cover immovable with respect to the sewing machine arm, and the like), and rotates the change amount switching cam 58 based on a signal of a control device 62 to be described later. An outer peripheral surface (cam surface) of the change amount switching cam 58 abuts on the contact 51*c* of the base plate 51. In addition, the base plate 51 is biased in a direction in which the contact 51*c* is pressed against the change amount switching cam 58 by the pressing spring 59 illustrated in FIG. 1. The cam surface of the change amount switching cam 58 is set such that a distance from a cam rotation center attached to the change amount switching motor 57 gradually changes. Therefore, when the change amount switching motor 57 is rotated to change an angle of the change amount switching cam 58 with respect to the contact 51*c*, an angle of the base plate 51 swinging around the upper shaft 6 is changed accordingly.

In the idler unit 50 configured as described above, when the upper shaft 6 rotates, the rotating body 55 rotates in synchronization with the rotation of the upper shaft 6, and a distance between the idler 56 attached to the rotating body 55 and the upper and lower shaft belt 17 changes. Depending on a rotation angle of the change amount switching cam 58, when the upper shaft 6 rotates, for example, the idler 56 that has been separated from the upper and lower shaft belt 17 come into contact with the upper and lower shaft belt 17, and an operation of further pushing the upper and lower shaft belt 17 and separating again from the upper and lower shaft belt 17 is repeated. In the present embodiment, since two idlers 56 are provided, the above-described operation by idlers 56 is performed twice while the rotating body 55 is rotated once. Note that a diameter ratio (ratio of the number of teeth) between the upper synchronous drive pulley 52 and the lower synchronous drive pulley 53 in the present embodiment is set to 1:2. Therefore, during one stitch formation performed by one rotation of the upper shaft 6, an operation of the idler 56 to contact, push, and separate from the upper and lower shaft belt 17 is performed one cycle in synchronization with the rotation of the upper shaft 6.

As illustrated in FIG. 1, in the sewing machines 1A and 1B of the present embodiment, the upper shaft 6 is a driving side and the lower shaft 15 is a driven side with respect to the upper and lower shaft belt 17. Therefore, when the tension side of the upper and lower shaft belt 17 is pushed in by the idler 56, a tension side belt length changes, and the phase of the lower shaft 15 with respect to the upper shaft 6 advances. As described above, the upper shaft 6 operates the needle 10 and the balance 13, and the lower shaft 15 operates the hook 19 and the feed dog 27. Therefore, during one stitch formation when the upper shaft 6 is rotated once, operations of the hook 19 and the feed dog 27 with respect to operations of the needle 10 and the balance 13 can be shifted from an initially set timing to a timing at which the operations of the hook 19 and the feed dog 27 are advanced, and can be returned to the initial timing again. In addition, since the upper shaft 6 and the rotating body 55 rotate synchronously, this timing change is realized at high speed.

In addition, in the idler unit 50, by changing a rotation angle of the change amount switching motor 57, the angle of the base plate 51 swinging around the upper shaft 6 can be changed. That is, since the maximum pushing amount when the upper and lower shaft belt 17 is pushed in can be changed by the idler 56, a maximum amount of a phase difference of the lower shaft 15 with respect to the upper shaft 6 can be changed. Therefore, a shift amount of the operation timings of the hook 19 and the feed dog 27 with respect to the operation timings of the needle 10 and the balance 13 can be changed according to the rotation angle of the change amount switching motor 57.

When the idler 56 is pushed in or separated from the upper and lower shaft belt 17 as described above, tension of the upper and lower shaft belt 17 fluctuates. Therefore, as illustrated in FIG. 1, each of the sewing machines 1A and 1B according to the present embodiment includes a tension spring 60 and a tension idler 61 biased by the tension spring 60 and pressed against a loosened side of the upper and lower shaft belt 17. When the tension of the upper and lower shaft belt 17 changes, a displacement amount of the tension spring 60 changes according to change in tension, so that fluctuation in tension of the upper and lower shaft belt 17 can be absorbed.

Figure 4:
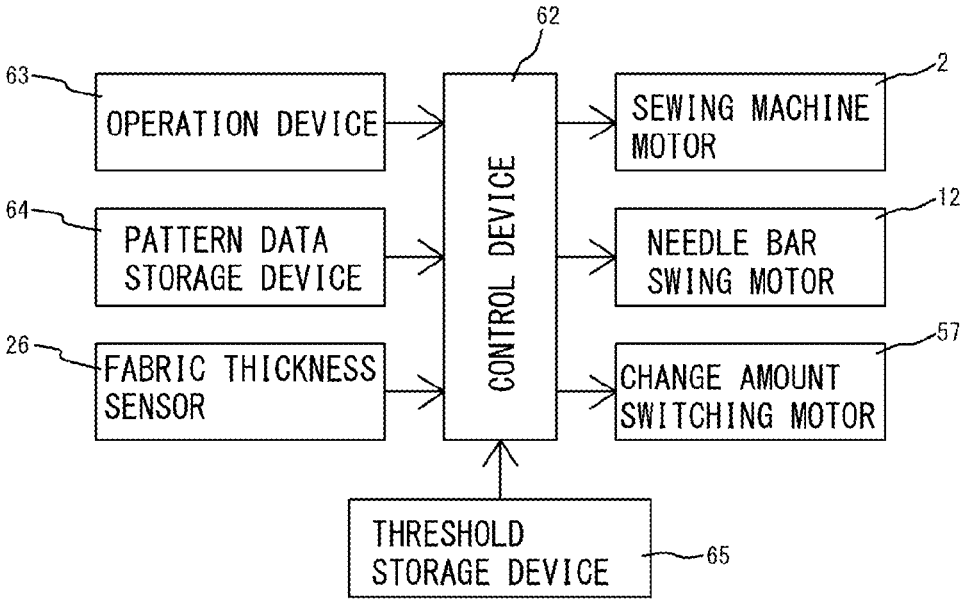
FIG. 4 is a block diagram of the sewing machine illustrated in FIG. 1.

In addition, an electrical connection in each of the sewing machines 1A and 1B of the present embodiment is configured as illustrated in the block diagram of FIG. 4. Here, the control device 62 controls various operations of the sewing machines 1A and 1B, and is electrically connected to an operation device 63 that receives an operation from an operator, a pattern data storage device 64 that stores pattern data for performing complicated pattern stitching, and a threshold storage device 65, in addition to the sewing machine motor 2, the needle bar swing motor 12, the fabric thickness sensor 26, and the change amount switching motor 57 described above. Note that the threshold storage device 65 will be described in detail later.

According to the sewing machines 1A and 1B having the above configuration, for example, even when the operation timings of the balance 13 and the feed dog 27 are changed according to the thickness of the fabric when sewing fabrics having different thicknesses, the influence on the timing at which the needle 10 and the hook 19 come closest to each other can be avoided. In addition, for example, in a case of swinging the needle 10 in a direction perpendicular to the fabric feeding direction as in zigzag sewing, operations of the balance 13 and the feed dog 27 can be prevented from being affected while adjusting a timing of bringing the hook 19 closest according to left and right positions of the needle 10. Hereinafter, these points will be described in detail.

Figure 5:
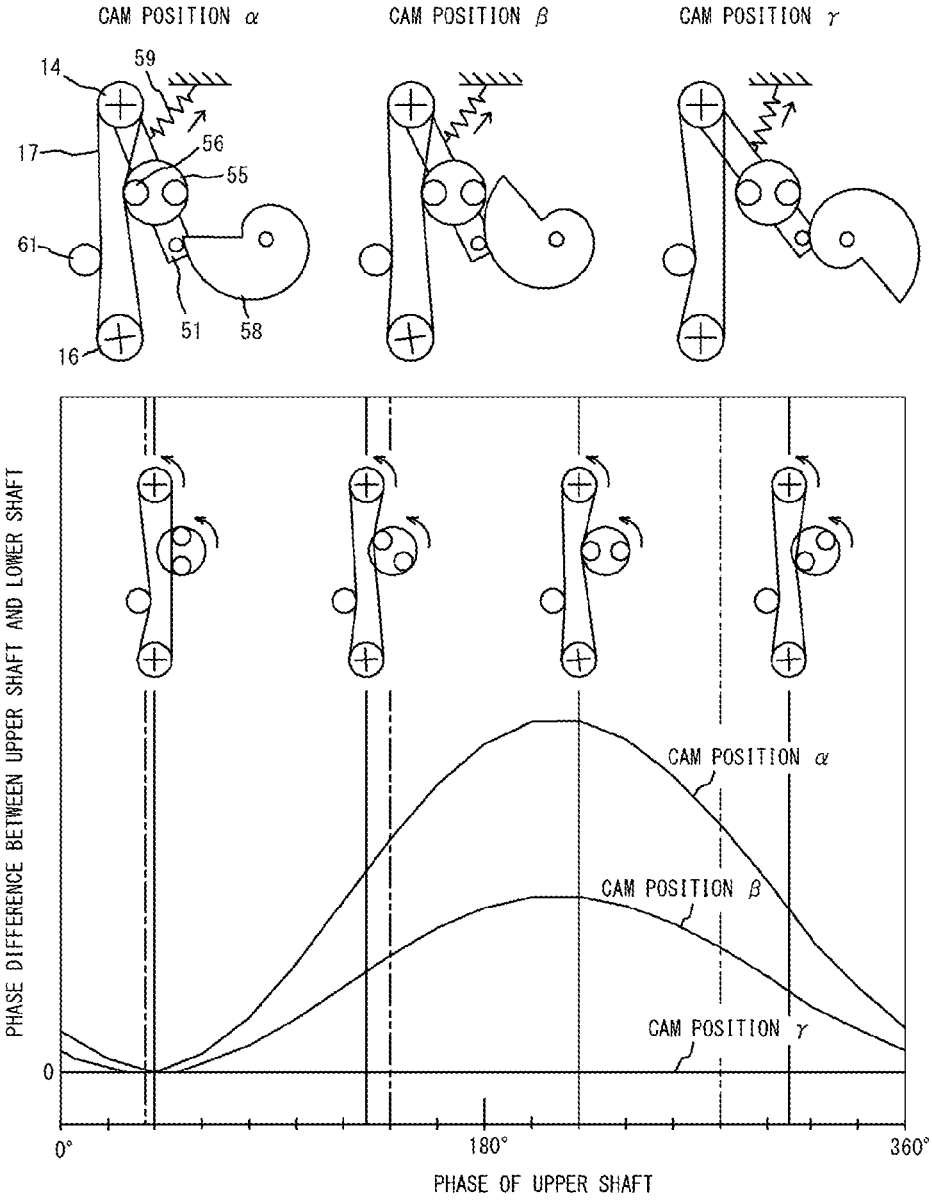
FIG. 5 is a diagram illustrating a relationship between a phase of an upper shaft and a phase difference between the upper shaft and a lower shaft in a case where operation timings of a balance and a feed dog can be adjusted regarding the sewing machine of the first embodiment.

First, a case of sewing fabrics having different thicknesses using the sewing machine 1A of the first embodiment will be described with reference to FIGS. 5 to 7. Here, an upper diagram of FIG. 5 illustrates that when the rotation angle of the change amount switching cam 58 is changed by the change amount switching motor 57 (see FIG. 3), the maximum pushing amount of the idler 56 with respect to the upper and lower shaft belt 17 changes accordingly. Note that the pressing spring 59 illustrated in FIG. 5 is illustrated as a tension spring for convenience of illustration and is different from the pressing spring 59 (compression spring) in FIG. 1. However, the pressing spring 59 may be of any type as long as the base plate 51 is pressed against the change amount switching cam 58. In addition, a lower diagram of FIG. 5 illustrates that, when the upper shaft 6 is rotated once, the pushing amount of the idler 56 with respect to the upper and lower shaft belt 17 is periodically changed by the rotating body 55 rotating in synchronization with the upper shaft 6, and accordingly, the phase difference of the lower shaft 15 with respect to the upper shaft 6 is periodically changed. Note that the lower diagram of FIG. 5 illustrates a periodic change of the phase difference when the phase of the upper shaft 6 is taken on a horizontal axis and the phase difference between the upper shaft 6 and the lower shaft 15 is taken on a vertical axis. In the case of sewing fabrics having different thicknesses, as illustrated in the lower diagram of FIG. 5, a positional relationship between the upper shaft 6 and the rotating body 55 is set such that the two idlers 56 are arranged vertically (parallel to the upper and lower shaft belt 17) when the phase of the upper shaft 6 is about 40°, and the two idlers 56 are arranged horizontally (at a right angle to the upper and lower shaft belt 17) when the phase of the upper shaft 6 is about 220°. In addition, as described above, since a diameter ratio (ratio of the number of teeth) between the upper synchronous drive pulley 52 and the lower synchronous drive pulley 53 in the present embodiment is 1:2, when the upper shaft 6 is rotated once (360° rotation), the rotating body 55 is rotated by a half-rotation (180° rotation).

As illustrated in the upper diagram of FIG. 5, a cam position α is a state where a distance from a cam rotation center of the change amount switching cam 58 to the contact 51*c* is longest, and is a state where the maximum pushing amount of one of the idlers 56 with respect to the upper and lower shaft belt 17 is largest. When the upper shaft 6 rotates at the cam position α, the rotating body 55 rotates in synchronization with the rotation, so that the upper and lower shaft belt 17 is periodically pushed in by the idler 56. Therefore, as illustrated in the lower diagram of FIG. 5, the phase difference between the upper shaft 6 and the lower shaft 15 also periodically changes. In the present embodiment, the phase difference between the upper shaft 6 and the lower shaft 15 is minimum (the phase difference is 0) when the phase of the upper shaft 6 is about 40°, and the phase difference between the upper shaft 6 and the lower shaft 15 is maximum when the phase of the upper shaft 6 is about 220°.

On the other hand, as illustrated in a cam position β in the upper diagram of FIG. 5, when the rotation angle of the change amount switching cam 58 is changed from the cam position α, the maximum pushing amount of the idler 56 with respect to the upper and lower shaft belt 17 gradually decreases. Therefore, as illustrated in the lower diagram of FIG. 5, when the upper shaft 6 rotates at the cam position β, the phase difference between the upper shaft 6 and the lower shaft 15 periodically changes similarly to the cam position α, but a maximum value of the phase difference is smaller than that at the cam position α. Note that in a case where the rotation angle of the change amount switching cam 58 is changed to a cam position γ, the idler 56 is at a position not in contact with the upper and lower shaft belt 17 even if the rotating body 55 rotates. Therefore, at the cam position γ, as illustrated in the lower diagram of FIG. 5, the phase difference between the upper shaft 6 and the lower shaft 15 remains 0 even when the upper shaft 6 rotates.

Figure 6:
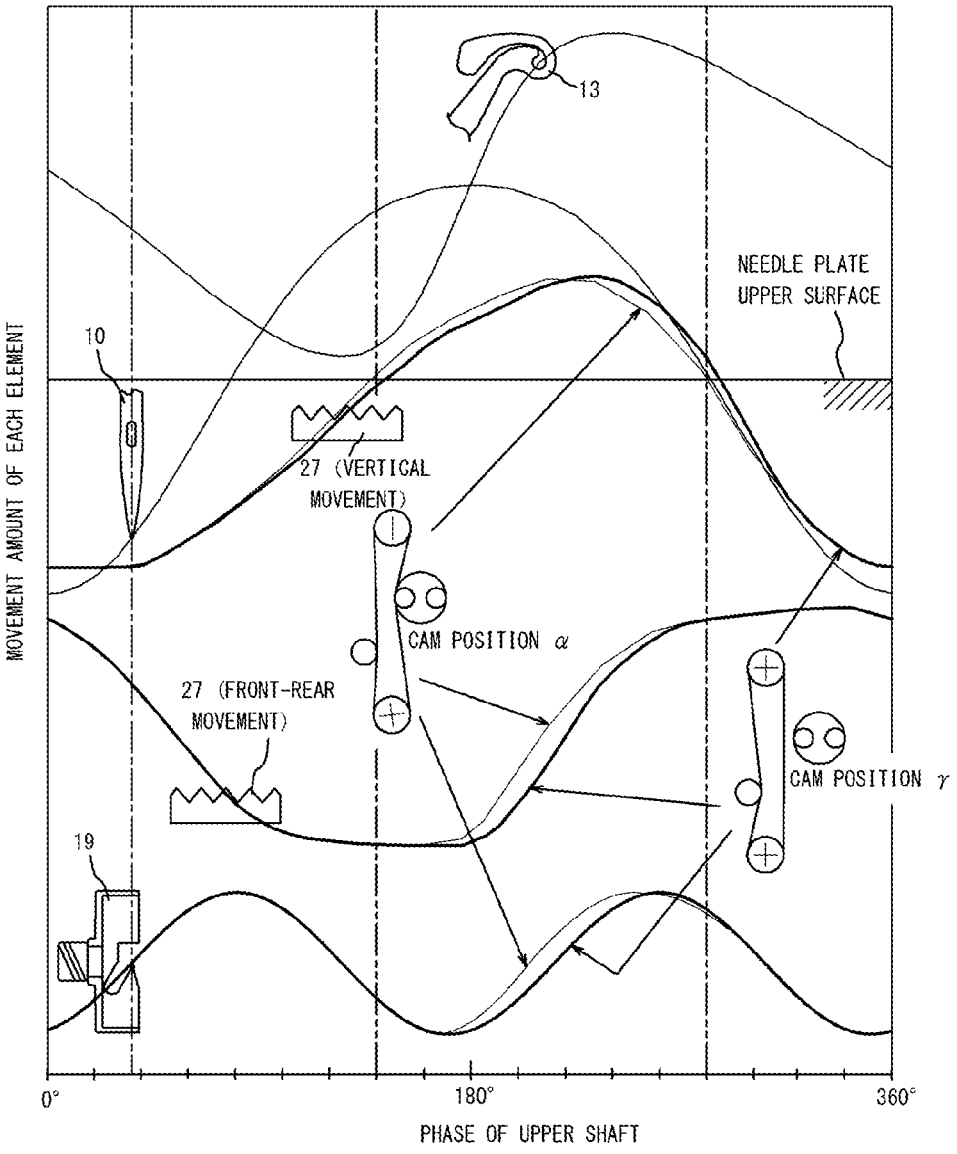
FIG. 6 is a motion diagram illustrating a relationship between the phase of the upper shaft and movement amounts of a needle, the balance, a hook, and the feed dog in a case illustrated in FIG. 5.

Here, FIG. 6 is a motion diagram illustrating a relationship between the phase of the upper shaft 6 and a movement amount of each element (the needle 10, the balance 13, the hook 19, and the feed dog 27) of the sewing machine 1A. In FIG. 6, a case where the sewing machine 1A is operated at the cam position α and a case where the sewing machine 1A is operated at the cam position γ are illustrated in an overlapping manner. The motion diagram of the needle 10 illustrated in FIG. 6 illustrates the movement amount in the vertical direction of a distal end portion of the needle 10, and the distal end portion of the needle 10 is located above an upper surface of the needle plate 21 when the phase of the upper shaft 6 is in a range of about 80° to 280°. In addition, the motion diagram of the balance 13 illustrates the movement amount in the vertical direction of the hole through which the upper thread is inserted into the balance 13. The motion diagram of the hook 19 illustrates an amount of leftward and rightward movement of the tip 20, where a portion indicated by a thin line illustrates the movement amount at the cam position α and a portion indicated by a thick line illustrates the movement amount at the cam position γ. In addition, the feed dog 27 separately illustrates a motion diagram illustrating the movement amount in the vertical direction and a motion diagram illustrating the movement amount in a front-rear direction, where portion indicated by a thin line indicates the movement amount at the cam position α, and a portion indicated by a thick line indicates the movement amount at the cam position γ. In addition, as indicated by two-dot chain lines of the lower diagram in FIG. 5 and in FIG. 6, the feed dog 27 protrudes from the upper surface of the needle plate 21 when the phase of the upper shaft 6 is in the range of about 140° to 280°. Note that as indicated by dashed lines in the lower diagram of FIG. 5 and FIG. 6, the needle 10 and the tip 20 intersect (come closest to) each other when the phase of the upper shaft 6 is about 40°, and the tip 20 catches the loop of the upper thread at this phase as described above.

As described above, at the cam position γ, even when the rotating body 55 rotates, the idler 56 does not come into contact with the upper and lower shaft belt 17, and the phase difference between the upper shaft 6 and the lower shaft 15 is 0. On the other hand, at the cam position α, since the pushing amount of the idler 56 into the upper and lower shaft belt 17 periodically changes with the rotation of the rotating body 55, the phase difference between the upper shaft 6 and the lower shaft 15 also periodically changes. Here, description will be made based on a motion diagram (thick line), of FIG. 6, in the hook 19 at the cam position γ where the upper and lower shaft belt 17 is not pushed. If the pushing amount of the idler 56 into the upper and lower shaft belt 17 does not change and is constant, and the phase difference between the upper shaft 6 and the lower shaft 15 is also constant, the motion diagram at that time is represented as a curve in which the thick line, which is the motion diagram of the hook 19, is moved to left of the drawing as a whole by an amount corresponding to the pushing amount. On the other hand, in the present embodiment, since the pushing amount, that is, the phase difference between the upper shaft 6 and the lower shaft 15 periodically changes, as in the motion diagram (thin line) in the hook 19 at the cam position α of FIG. 6, there are a portion partially different from the motion diagram (thick line) and shifted from the thick line and a portion overlapping the thick line. That is, in FIG. 6, in the portion where the thin line of the hook 19 overlaps the thick line, the hook 19 can be operated at a same timing as the case where the phase difference between the upper shaft 6 and the lower shaft 15 is 0 even in the state where the cam position α is set. In the portion where the thin line is shifted from the thick line, the hook 19 can be operated at a timing different from the case where the phase difference between the upper shaft 6 and the lower shaft 15 is 0

Here, referring to the motion diagram illustrating the movement amount of the feed dog 27 in the vertical direction in FIG. 6, in a range where the phase of the upper shaft 6 in which the feed dog 27 protrudes from the needle plate 21 is about 140° to 280°, that is, in a range where fabric feeding by the feed dog 27 is effective, the motion diagram illustrating the movement amount of the feed dog 27 in the front-rear direction is earlier in the phase of the upper shaft 6 at the cam position α than that at the cam position γ by about 10°. On the other hand, in other ranges, in particular, when the phase of the upper shaft 6 where the needle 10 and the tip 20 intersect is about 40°, the motion diagrams of the feed dog 27 at the cam position α and at the cam position γ overlap each other. Therefore, if the state of the cam position α is set so that the pushing amount of the idler 56 into the upper and lower shaft belt 17 changes periodically, the operation timing of the feed dog 27 with respect to the balance 13 can be advanced only in a range in which the fabric feeding by the feed dog 27 is effective. Therefore, in the case of sewing a thin fabric, it is possible to perform sewing with soft stitches by setting the state of the cam position α and advancing the operation timing of the feed dog 27 with respect to the balance 13.

Note that as illustrated in the lower diagram of FIG. 5, while the pushing amount of the idler 56 into the upper and lower shaft belt 17 at the cam position β periodically changes similarly to the case of the cam position α, the pushing maximum amount is smaller than that at the cam position α. That is, even at the cam position β, the operation timing of the feed dog 27 can be advanced from the operation timing of the balance 13 only in the range where the fabric feeding by the feed dog 27 is effective, but the operation timing that can be advanced is smaller than that at the cam position α. Therefore, by changing the rotation angle of the change amount switching cam 58 by the change amount switching motor 57, the operation timing of the feed dog 27 with respect to the balance 13 can be optimized according to the fabric thickness.

Figure 7:
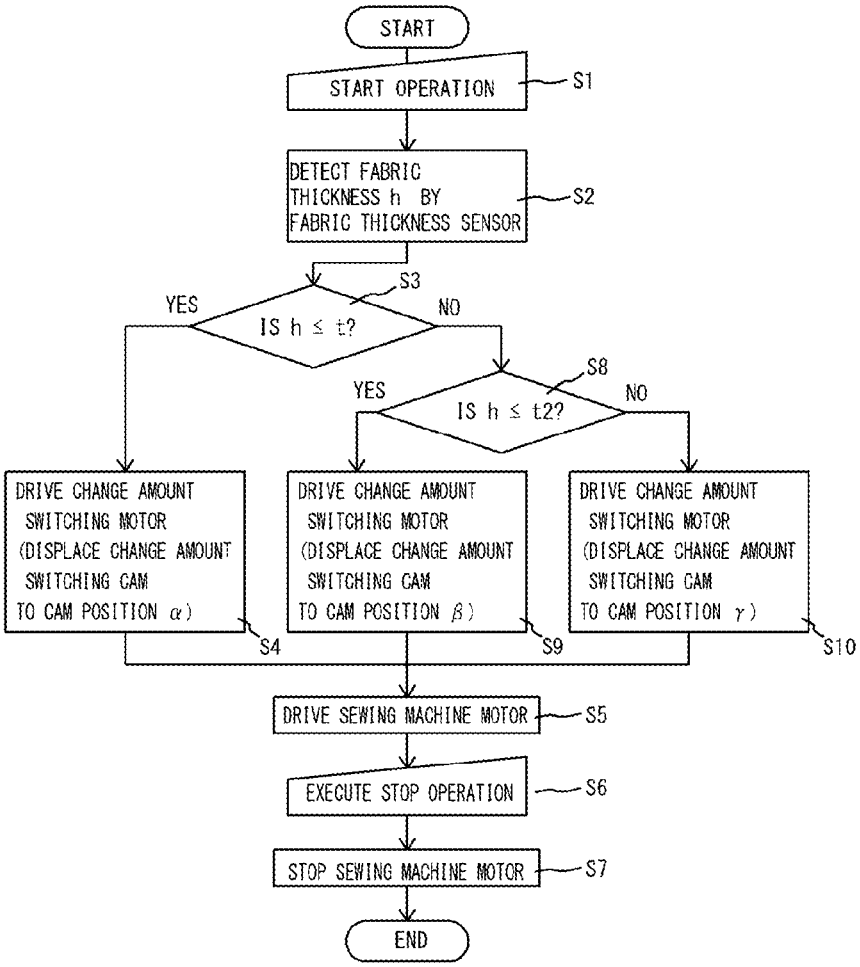
FIG. 7 is a flowchart in the case illustrated in FIG. 5.

FIG. 7 is a flowchart of the sewing machine 1A in a case of sewing fabrics having different thicknesses. In the present embodiment, two fabric thickness thresholds (t1 and t2, t1<t2) are set, and the thresholds t1 and t2 are stored in the threshold storage device 65 illustrated in FIG. 4. When the operator executes a start operation from the operation device 63 (S1 in FIG. 7), the fabric thickness sensor 26 detects a fabric thickness h of a fabric held by the presser 22 at the start of sewing (S2 in FIG. 7), and it is determined whether the fabric thickness h is equal to or less than the threshold t1 (S3 in FIG. 7). When the fabric thickness h is equal to or less than the threshold t1, the change amount switching motor 57 is rotated based on a command from the control device 62 to displace the change amount switching cam 58 to the cam position α (S4 in FIG. 7). As described above, in the state of the cam position α, the operation timing of the feed dog 27 can be advanced to the maximum with respect to the balance 13. Therefore, when the sewing machine motor 2 is driven to perform sewing (S5 in FIG. 7), even a thin fabric can be sewn with soft stitches as described above. Thereafter, the operator executes a stop operation from the operation device 63 (or sewing based on data stored in the pattern data storage device 64 is finished) (S6 in FIG. 7), whereby the sewing machine motor 2 is stopped (S7 in FIG. 7). Note that when the fabric thickness h is larger than the threshold t1, it is determined whether the fabric thickness h is equal to or less than the threshold t2 (S8 in FIG. 7). When the fabric thickness h is equal to or less than the threshold t2, the change amount switching motor 57 is rotated to displace the change amount switching cam 58 to the cam position β (S9 in FIG. 7), and then the steps from S5 are continuously executed. When the fabric thickness h is larger than the threshold t2, the change amount switching motor 57 is rotated to displace the change amount switching cam 58 to the cam position γ (S10 in FIG. 7), and then the steps from S5 are continuously executed. Therefore, even a thick fabric can be sewn with optimum stitches by tightening the upper thread with the balance 13.

Figure 8:
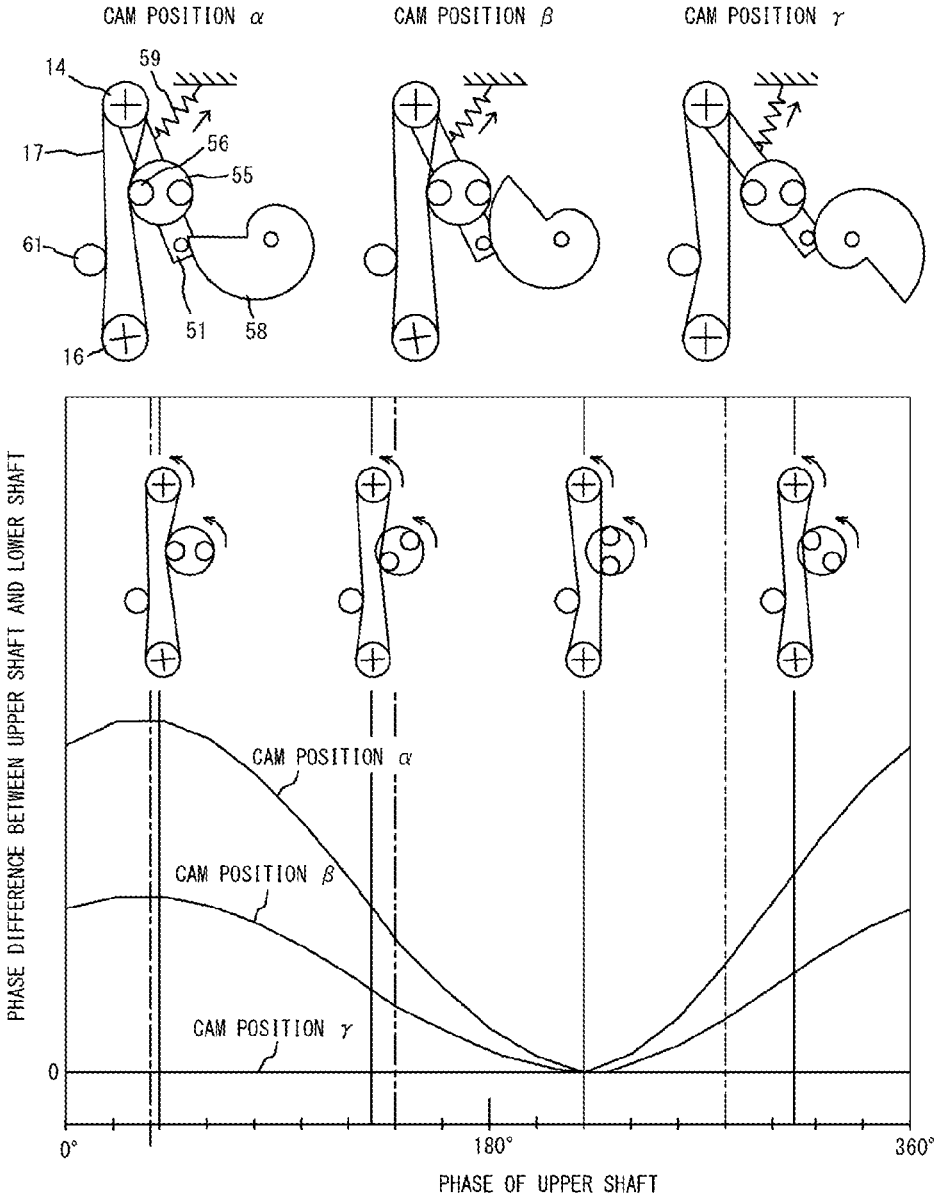
FIG. 8 is a diagram illustrating a relationship between a phase of an upper shaft and a phase difference between the upper shaft and a lower shaft in a case where operation timings of a needle and a hook can be adjusted regarding the sewing machine of the second embodiment.

Next, a sewing machine 1B, which is a second embodiment of the sewing machine according to the present invention, in which the operation timings of the needle 10 and the tip 20 can be adjusted, will be described with reference to FIGS. 8 to 10. The sewing machine 1B of the second embodiment is the same as the sewing machine 1A of the first embodiment in terms of components as illustrated in FIGS. 1, 3, and 4. On the other hand, the positional relationship between the upper shaft 6 and the rotating body 55 is different from that of the sewing machine 1A of the first embodiment. As illustrated in the lower diagram of FIG. 8, the sewing machine 1B is set so that the two idlers 56 are arranged horizontally (at a right angle with respect to the upper and lower shaft belt 17) when the phase of the upper shaft 6 is about 40°, and the two idlers 56 are arranged vertically (in parallel with respect to the upper and lower shaft belt 17) when the phase of the upper shaft 6 is about 220°. Here, an upper diagram of FIG. 8 illustrates that, similarly to the upper diagram of FIG. 5, when the rotation angle of the change amount switching cam 58 is changed by the change amount switching motor 57 (see FIG. 3), the maximum pushing amount of the idlers 56 with respect to the upper and lower shaft belt 17 changes accordingly. In addition, similarly to the lower diagram of FIG. 5, a lower diagram of FIG. 8 also illustrates that when the upper shaft 6 is rotated once, the pushing amount of the idlers 56 with respect to the upper and lower shaft belt 17 periodically changes in synchronization with the upper shaft 6, and accordingly, the phase difference of the lower shaft 15 with respect to the upper shaft 6 periodically changes.

Figure 9:
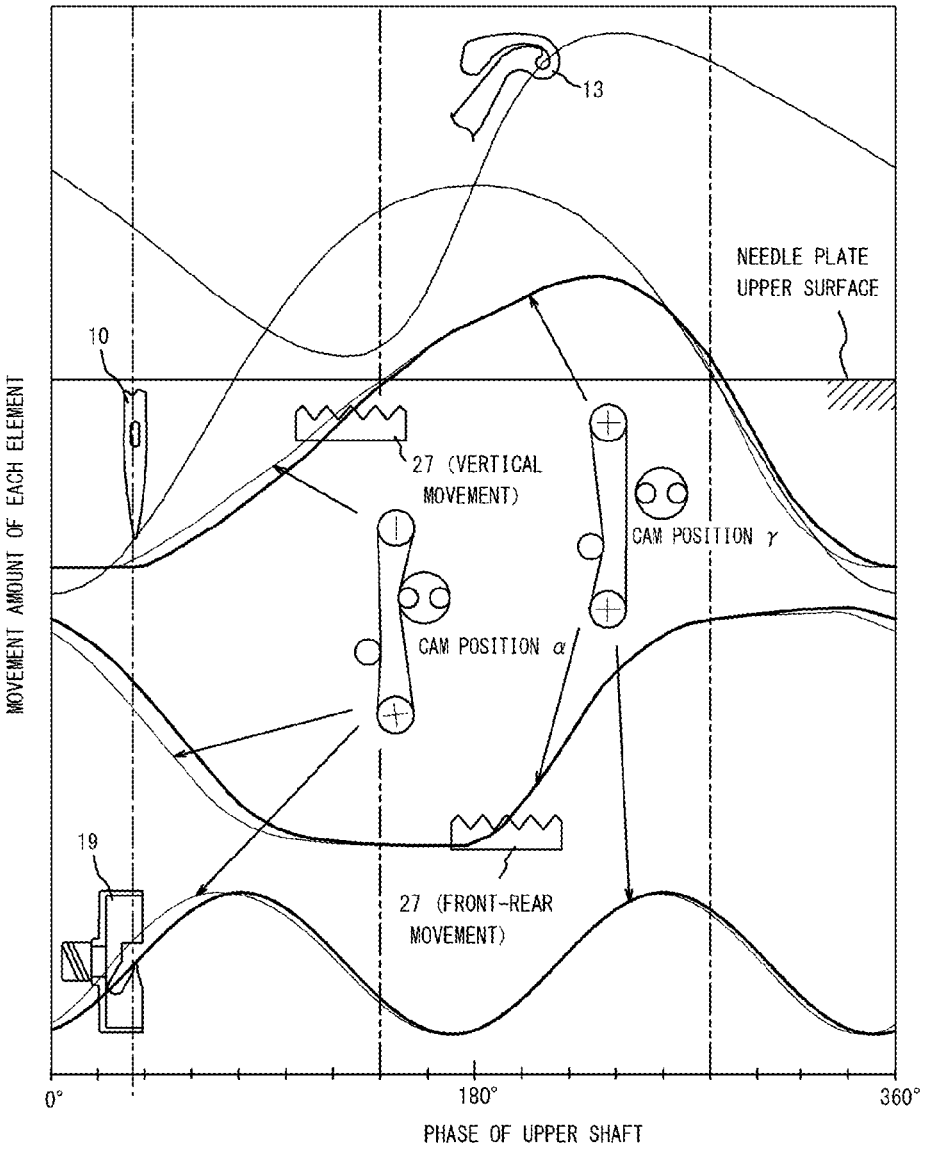
FIG. 9 is a motion diagram illustrating a relationship between the phase of the upper shaft and movement amounts of the needle, a balance, the hook, and a feed dog in a case illustrated in FIG. 8.

FIG. 9 is a motion diagram illustrating a relationship between the upper shaft 6 of the sewing machine 1B and a movement amount of each element (the needle 10, the balance 13, the hook 19, and the feed dog 27) in the second embodiment in a state similar to that in FIG. 6.

In FIG. 9, when the phase of the upper shaft 6 at which the needle 10 and the tip 20 intersect (come closest to each other) is about 40°, which is indicated by dashed lines, a motion diagram of the hook 19 at the cam position α is about 10° earlier in the phase of the upper shaft 6 than that at the cam position γ. On the other hand, in other ranges (for example, a range of about 140° to 280° of the phase of the upper shaft 6 indicated by a two-dot chain line, in which the feed dog 27 protrudes from the needle plate 21 and fabric feeding is effective), motion diagrams of the hook 19 at the cam position α and at the cam position γ overlap with each other. Therefore, if the state of the cam position α is set so that the pushing amount of the idler 56 into the upper and lower shaft belt 17 changes periodically, the operation timing of the tip 20 with respect to the needle 10 can be changed (advanced) only in the state where the needle 10 and the tip 20 intersect.

Note that as illustrated in the lower diagram of FIG. 8, while the pushing amount of the idler 56 into the upper and lower shaft belt 17 at the cam position β periodically changes similarly to the cam position α, the pushing maximum amount is smaller than the cam position α. That is, even at the cam position β, the operation timing of the tip 20 can be advanced with respect to the needle 10 only in a state where the needle 10 and the tip 20 intersect, but the operation timing that can be advanced is smaller than the cam position α. As illustrated in FIG. 1, since the hook 19 of the present embodiment rotates counterclockwise in plan view, when a position where the needle 10 penetrates the fabric (needle fall position) moves to a right side, the operation timing of the hook 19 is delayed with respect to a state where the needle 10 does not tilt to the left and right but falls, and when the position where the needle 10 falls moves to a left side, the operation timing of the hook 19 is advanced, so that the needle 10 and the tip 20 can be uniformly crossed. Therefore, if the needle 10 and the tip 20 are set to intersect with each other at the cam position γ when the position at which the needle 10 falls is on a rightmost side, the operation timing of the tip 20 with respect to the needle 10 can be gradually advanced by changing the rotation angle of the change amount switching cam 58 by the change amount switching motor 57. Therefore, even if the needle 10 is moved left and right, the tip 20 can uniformly intersect with the needle 10.

Figure 10:
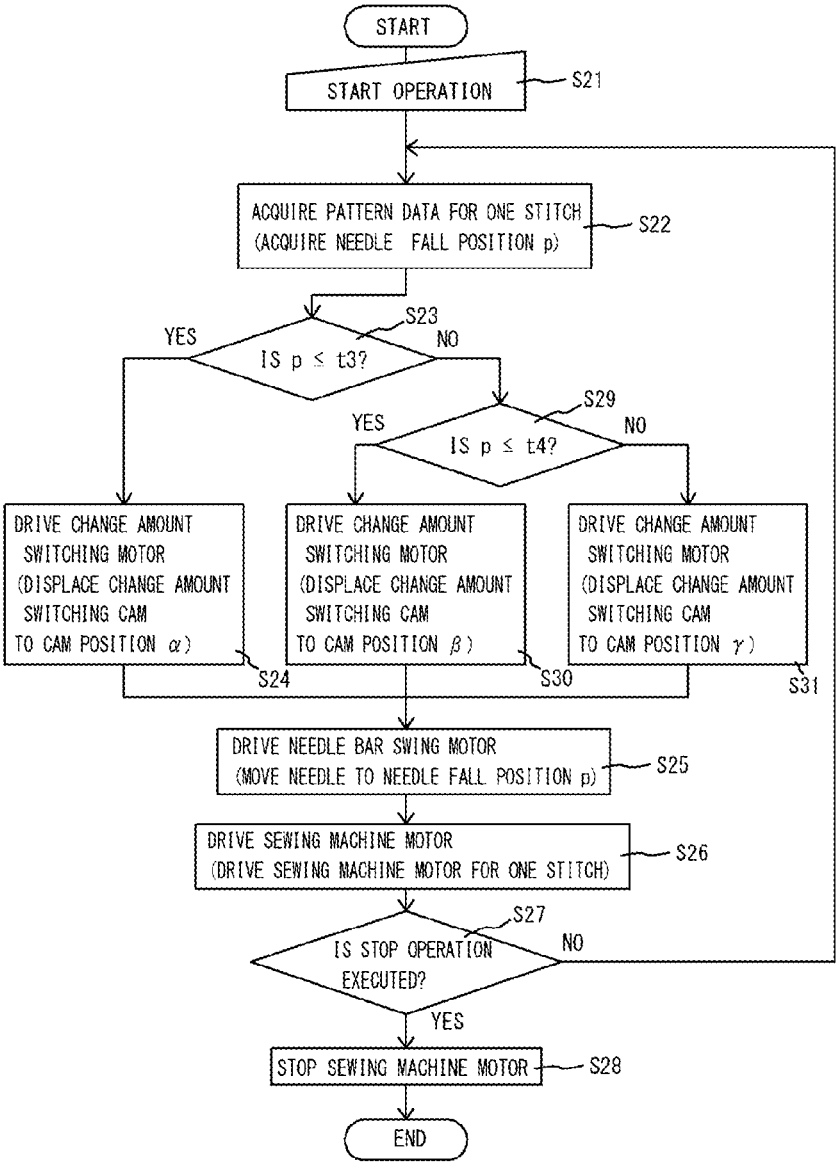
FIG. 10 is a flowchart in the case illustrated in FIG. 8.

FIG. 10 is a flowchart in a case where sewing is performed by swinging the needle 10 in a direction perpendicular to the fabric feeding direction in the sewing machine 1B of the second embodiment. In the present embodiment, two thresholds (t3 and t4) are set for positions at which the needle 10 falls (the left and right positions of the needle 10 with respect to the hook 19), and the thresholds t3 and t4 are stored in the threshold storage device 65 illustrated in FIG. 4. When the operator executes the start operation from the operation device 63 (S21 in FIG. 10), a position p at which the needle 10 falls on the fabric to form the next stitch is acquired from the pattern data stored in the pattern data storage device 64 (S22 in FIG. 10), and it is determined whether the needle fall position p is equal to or less than the threshold t3 (whether the needle fall position p is on the left side of the threshold t3) (S23 in FIG. 10). When the needle fall position p is equal to or less than the threshold t3, the change amount switching motor 57 is rotated based on a command from the control device 62 to displace the change amount switching cam 58 to the cam position α (S24 in FIG. 10), and the needle bar swing motor 12 is driven based on the command from the control device 62 to move the needle 10 to the needle fall position p (S25 in FIG. 10). Therefore, when the sewing machine motor 2 is driven by one stitch (S26 in FIG. 10), even if the needle 10 is moved to the left side, the tip 20 can pass through the loop of the upper thread formed by the needle 10 and can reliably catch the loop, so that a stitch can be formed without any problem. Thereafter, it is determined whether the sewing based on the pattern data stored in the pattern data storage device 64 has been finished (whether the stop operation has been executed) (S27 in FIG.

10). If the stop operation has been executed, the sewing machine motor 2 is stopped (S28 in FIG. 10), and if the stop operation has not been executed, formation of the next stitch is executed. Note that when the needle fall position p on the fabric is larger than the threshold t3, it is determined whether the needle fall position p is equal to or less than the threshold t4 (S29 in FIG. 10). Then, when the needle fall position p is equal to or less than the threshold t4, the change amount switching motor 57 is rotated to displace the change amount switching cam 58 to the cam position β (S30 in FIG. 10), and the steps from S25 are continuously executed. When the needle fall position p is larger than the threshold t4, the change amount switching motor 57 is rotated to displace the change amount switching cam 58 to the cam position γ (S31 in FIG. 10), and the steps from S25 are continuously executed. Therefore, even if the needle 10 is moved left and right, the tip 20 can uniformly intersect with the needle 10.

Although one embodiment of the present invention has been described above, the present invention is not limited to the specific embodiment, and various modifications and changes can be made within the scope of the gist of the present invention described in the claims unless otherwise limited in the above description. In addition, the effects of the above embodiment are merely examples of the effects caused by the present invention, and do not mean that the effects of the present invention are limited to the above effects.

Figure 11:
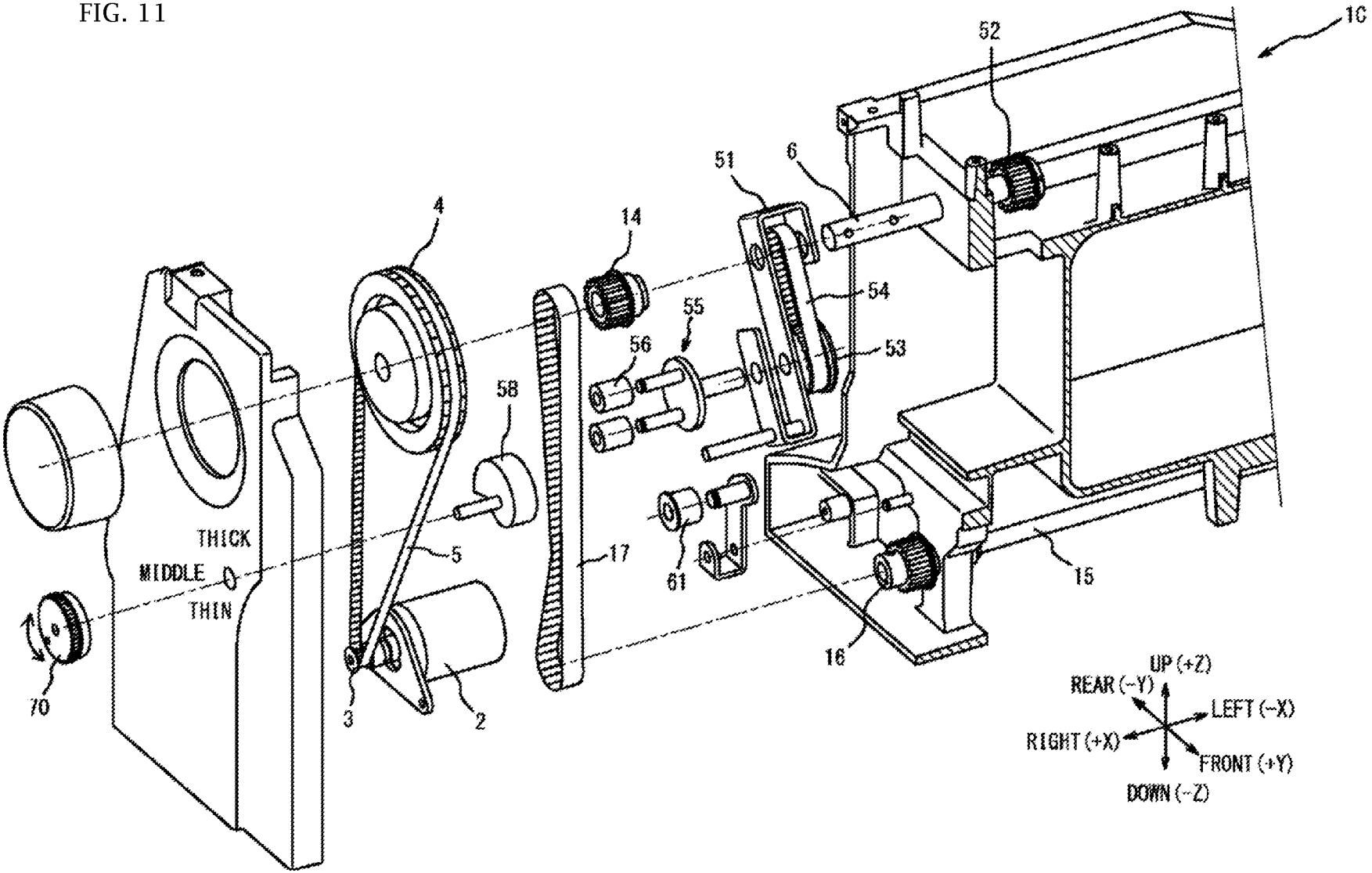
FIG. 11 is an exploded perspective view of another embodiment of the sewing machine according to the present invention.

For example, in the case of sewing fabrics having different thicknesses in the sewing machine 1A of the first embodiment (see FIGS. 5 to 7), the fabric thickness is detected by the fabric thickness sensor 26, the rotation angle of the change amount switching cam 58 is changed by the change amount switching motor 57 based on the detected fabric thickness, and the maximum pushing amount of the idler 56 with respect to the upper and lower shaft belt 17 is adjusted. However, a configuration illustrated in FIG. 11 may be adopted so that the operator can manually adjust the maximum pushing amount. In a sewing machine 10 illustrated in FIG. 11, a manual dial 70 is provided in the change amount switching cam 58, and the operator rotates the manual dial 70 according to the fabric thickness to change the rotation angle of the change amount switching cam 58. Also in this case, the operation timing of the feed dog 27 with respect to the balance 13 can be adjusted according to the fabric thickness. Note that in the sewing machine 10, the base plate 51, the manual dial 70, the change amount switching cam 58, and the pressing spring 59 correspond to the "swing mechanism" in the present specification.

Although the idler unit 50 described above is driven by the upper synchronous drive pulley 52 attached to the upper shaft 6, an element corresponding to the upper synchronous drive pulley 52 may be attached to the lower shaft 15 and driven by the lower shaft 15.

In the case of sewing fabrics having different thicknesses described above, in the example illustrated in FIGS. 5 and 6, the pushing amount of the idler 56 with respect to the upper and lower shaft belt 17 is set to be maximum in the vicinity where the feed dog 27 protrudes most upward from the needle plate 21 (the phase of the upper shaft 6 is about 220°). However, since it is enough if the operation timing of the feed dog 27 with respect to the balance 13 may be advanced within a range in which the fabric feeding by the feed dog 27 is effective, the pushing amount may be set to be maximum when the feed dog 27 is located above the needle plate 21.

In addition, in the case of swinging the needle 10 described above in the sewing machine 1B of the second embodiment in the direction perpendicular to the fabric feeding direction, in the example illustrated in FIGS. 8 and 9, the pushing amount of the idler 56 with respect to the upper and lower shaft belt 17 is set to be maximum in the vicinity where the needle 10 starts to rise (the phase of the upper shaft 6 is about 40°). However, since it is enough if the upper thread inserted into the needle hole of the needle 10 may be caught by the tip 20, the pushing amount may be set to be maximum when the needle hole of the needle 10 is located below the needle plate 21.

In the rotating body mechanism including the rotating body 55 and the idler 56 described above, the center of gravity of the rotating body 55 is on the rotation axis (central axis) of the shaft portion 55*b*, and the two idlers 56 are provided at positions symmetrical with respect to the central axis of the shaft portion 55*b*. That is, since the center of gravity of the rotating body mechanism is on the rotation axis of the shaft portion 55*b*, vibration and noise can be suppressed when the rotating body 55 rotates. In addition, in the present embodiment, by providing the two idlers 56, the rotating body 55 is set to be rotated by a half-rotation when the upper shaft 6 is rotated once. Therefore, the rotation speed of the rotating body 55 is reduced, so that vibration and noise can be further suppressed. The number of the idlers 56 may be three or more, and in this case as well, the center of gravity of the rotating body mechanism is preferably on the rotation axis of the shaft portion 55*b*. One idler 56 may be provided, and in this case, for example, it is preferable to provide a balancer on the rotating body 55 to position the center of gravity of the rotating body mechanism on the rotation axis.

In addition, as described with reference to FIGS. 2A to 2E, in order for the tip 20 to catch the loop of the upper thread and reliably form a stitch, the tip 20 may come closest at any timing in the range where the needle 10 is raised from a bottom dead center by δ2 to δ3. Therefore, in the sewing machine 1B of the second embodiment, it is described that the tip 20 can uniformly intersect with the needle 10 even if the needle 10 is moved to the left and right by a function of the idler 56, but the timing at which the tip 20 comes closest to the needle 10 may be adjusted to fall within the range of δ2 to δ3 even if it is not strictly uniform.

In addition, in the present embodiment, it is possible to change the maximum pushing amount of the idler 56 with respect to the upper and lower shaft belt 17 as illustrated in FIGS. 5 and 8 by the swing mechanism including the base plate 51 or the like, but for example, the swing mechanism may be eliminated for the purpose of prioritizing the simplification of the configuration.

REFERENCE SIGNS LIST

1A, 1B sewing machine
6 upper shaft
10 needle
13 balance
15 lower shaft
17 upper and lower shaft belt
19 hook
21 needle plate
27 feed dog
50 idler unit
55 rotating body
56 idler

What is claimed is:

1. A sewing machine comprising:
an upper shaft that drives a needle and a balance;
a lower shaft that drives a hook and a feed dog;
an upper and lower shaft belt that connects the upper shaft and the lower shaft and synchronizes rotation of the upper shaft with rotation of the lower shaft; and
an idler unit that includes an idler that comes into contact with the upper and lower shaft belt and pushes the idler into the upper and lower shaft belt to change a tension side belt length,
wherein the idler unit comprises:
a transmission mechanism connected to the upper shaft or the lower shaft; and
a rotating body mechanism provided with the idler and having a rotating body that rotates in synchronization with the upper shaft or the lower shaft by the transmission mechanism,
wherein a pushing amount of the idler into the upper and lower shaft belt is changed according to rotation of the rotating body, and
wherein a center of gravity of the rotating body mechanism is on a rotation axis of the rotating body.

2. The sewing machine according to claim 1, wherein the pushing amount is maximum when a needle hole of the needle is located below a needle plate.

3. The sewing machine according to claim 1, wherein the pushing amount is maximum when the feed dog is located above a needle plate.

4. A sewing machine comprising:
an upper shaft that drives a needle and a balance;
a lower shaft that drives a hook and a feed dog;
an upper and lower shaft belt that connects the upper shaft and the lower shaft and synchronizes rotation of the upper shaft with rotation of the lower shaft; and
an idler unit that includes an idler that comes into contact with the upper and lower shaft belt and pushes the idler into the upper and lower shaft belt to change a tension side belt length,
wherein the idler unit comprises:
a transmission mechanism connected to the upper shaft or the lower shaft; and
a rotating body mechanism provided with the idler and having a rotating body that rotates in synchronization with the upper shaft or the lower shaft by the transmission mechanism,
wherein a pushing amount of the idler into the upper and lower shaft belt is changed according to rotation of the rotating body, and
wherein the pushing amount is maximum when the feed dog is located above a needle plate.

5. A sewing machine comprising:
an upper shaft that drives a needle and a balance;
a lower shaft that drives a hook and a feed dog;
an upper and lower shaft belt that connects the upper shaft and the lower shaft and synchronizes rotation of the upper shaft with rotation of the lower shaft; and
an idler unit that includes an idler that comes into contact with the upper and lower shaft belt and pushes the idler into the upper and lower shaft belt to change a tension side belt length,
wherein the idler unit comprises:
a transmission mechanism connected to the upper shaft or the lower shaft; and
a rotating body mechanism provided with the idler and having a rotating body that rotates in synchronization with the upper shaft or the lower shaft by the transmission mechanism,
wherein a pushing amount of the idler into the upper and lower shaft belt is changed according to rotation of the rotating body, and
wherein the idler unit includes a swing mechanism that is swingable around the upper shaft or the lower shaft and swings the rotating body with respect to the upper and lower shaft belt.

6. The sewing machine according to claim 5, wherein the pushing amount is maximum when a needle hole of the needle is located below a needle plate.

7. The sewing machine according to claim 5, wherein the pushing amount is maximum when the feed dog is located above a needle plate.

8. The sewing machine according to claim 5, wherein a center of gravity of the rotating body mechanism is on a rotation axis of the rotating body.

9. The sewing machine according to claim 8, wherein the pushing amount is maximum when a needle hole of the needle is located below a needle plate.

10. The sewing machine according to claim 8, wherein the pushing amount is maximum when the feed dog is located above a needle plate.

* * * * *